United States Patent [19]

Marchello et al.

[11] 4,276,670

[45] Jul. 7, 1981

[54] SWIMMER'S FLOATATION AID

[76] Inventors: John L. Marchello; Barbara L. Marchello, both of P.O. Box 100, New Hudson, Mich. 48165

[21] Appl. No.: 85,820

[22] Filed: Oct. 17, 1979

[51] Int. Cl.[3] ..... B63C 9/08

[52] U.S. Cl. ..... 9/337; 9/342; 9/348

[58] Field of Search ..... 9/311, 329, 330, 333, 9/334, 335–345, 347, 348, 310 F

[56] References Cited

U.S. PATENT DOCUMENTS

| | | | |
|---|---|---|---|
| 2,898,610 | 8/1959 | Chamberlain | 9/339 |
| 3,050,753 | 8/1962 | Baker | 9/337 |
| 3,094,724 | 6/1963 | Lerner | 9/338 |
| 3,435,471 | 4/1969 | Drennen | 9/310 F |
| 3,574,244 | 4/1971 | Huss | 9/347 |
| 4,052,762 | 10/1977 | Zawislak | 9/342 |
| 4,194,257 | 3/1980 | Martin | 9/342 |

*Primary Examiner*—Trygve M. Blix
*Assistant Examiner*—D. W. Keen
*Attorney, Agent, or Firm*—Cullen, Sloman, Cantor, Grauer, Scott & Rutherford

[57] ABSTRACT

A floatation aid for swimmers, formed of a pair of relatively thin, resilient, buoyant, generally diamond shaped sheets of a size for arrangement upon and for extending over a substantial portion of the length of the front and rear surfaces of a human torso. Straps extend between the upper corners of the sheets over the wearer's shoulders. The lower corners of the sheets are interconnected by a crotch strap which includes a separate elongated strip of similar buoyant sheet material. A horizontal waist band extends around the middle of the wearer's body and the wider portion of the sheets and interconnects the adjacent sheet corners. The device provides limited floatation aid, but leaving the wearer's arms, shoulders and hip and leg areas uncovered and unrestricted for swimming type activities.

3 Claims, 5 Drawing Figures

SWIMMER'S FLOATATION AID

BACKGROUND OF THE INVENTION

In teaching swimming to beginners, and also in therapeutic swimming programs for swimmers who are somewhat handicapped, it is desirable to provide additional floatation for the swimmer's body. However, floatation aids of the typical life-jacket construction, whether formed of padded fibrous filled materials or buoyant plastic materials, generally are of a size and shape which interfere with swimming motions. Floatation belts, such as are commonly used in water skiing and the like activities, also provide floatation in only a limited area of the body and are inadequate for the purposes of generally supporting the torso while the swimmer develops sufficient confidence, in learning to swim, to no longer need such a device or to assist those who in some manner are physically handicapped.

Thus, there has been a need for a floatation assisting device, which is unlike a life-jacket or life vest in that it provides only limited floatation assistance, and is structured to support the torso of the swimmmer in the water without interfering with the movements of the swimmer's limbs and the shoulder and leg muscles and also provides minimum bulging or interference with the general shape of the swimmer's body.

Further, since the purpose of the device is to function for a limited time, ordinarily in swimming lessons for beginners, it is desirable to have a very simple and inexpensive construction.

SUMMARY OF INVENTION

The invention herein contemplates utilizing a pair of substantially identical, flat, relatively thin, resilient and buoyant plastic sheets formed in a generally diamond shape for application to the front and rear surfaces of a swimmer's torso and for extending from an area just below the neck to just above the crotch. The four corners of each sheet are provided with enlarged holes. Straps interconnect the upper corner holes and pass over the swimmer's shoulders. A strap, preferably including a strip of floatation material, similar to that of the sheets, passes between the swimmer's legs to interconnect the lower corners of the sheets. A waistband or strap encircles the swimmer's body, passing through the side corner holes for interconnecting the two sheets in the midsection of the body. Such waistband may be provided with suitable buckle or fastening means for easily releasing the aid from the body and for facilitating application upon the swimmer's body.

The sheets are of a size and shape to provide a substantial floatation assist for the swimmer's torso. However, they are not designed to substitute for a life-jacket, but are merely for floatation assistance so that the swimmer otherwise has the feeling of swimming freely. Moreover, the diamond shape design positions the sheet for maximum area of load support while avoiding covering or otherwise restricting the swimmer's upper shoulder and arm muscles, the swimmer's hip or upper leg areas, etc. In essence, the aid does not interfere with the normal motions of the swimmer during swimming activity nor give the swimmer the feeling of wearing an encumbrance against body movement.

One object of this construction is to provide an inexpensive aid. This is accomplished to a considerable extent by utilizing simple connections between the sheets, i.e., the corner holes and flexible strap connections. Hence, the device is relatively simple to construct and is assembled with minimum parts and labor.

Another object of the invention herein is to provide the lower or crotch strap in a form which both assists in properly positioning the aid upon the human torso, and also provides an additional floatation support at the lower end of the torso, i.e., between the legs in the crotch area, without interfering with the swimmer's movements.

It is contemplated to form the swimmer's floatation aid in several different sizes, such as large, medium and small, to handle swimmers ranging from a heavy adult down to a relatively small child. Precise sizing of the device to the body is unnecessary, as can be seen by the open construction which does not require close fitting. Thus, the minumum number of sizes can be utilized to cover the wide range of sizes and shapes of the users.

These and other objects and advantages of this invention will become apparent upon reading the following description, of which the attached drawings form a part.

DETAILED DESCRIPTION

The swimmer's floatation aid, generally designated 10, comprises a pair of similar front and rear sheets 11 and 12 which are diamond shaped. The precise shape can be varied. For example, squares turned upright on lower corners can be utilized to provide the diamond shape or alternatively the sheets can be vertically elongated.

The sheets are made of a relatively thin, resilient, buoyant, flexible foam plastic material, such as foamed polyurethane or the like. The particular plastic selected is not significant to the invention herein, so long as it meets the physical requirements of providing floatation, being water-tight, flexible, resilient, and durable for the purpose. By way of example, a one-inch thick polyurethane foam of suitable flexibility has been found to be adequate for this purpose.

Figure 1:
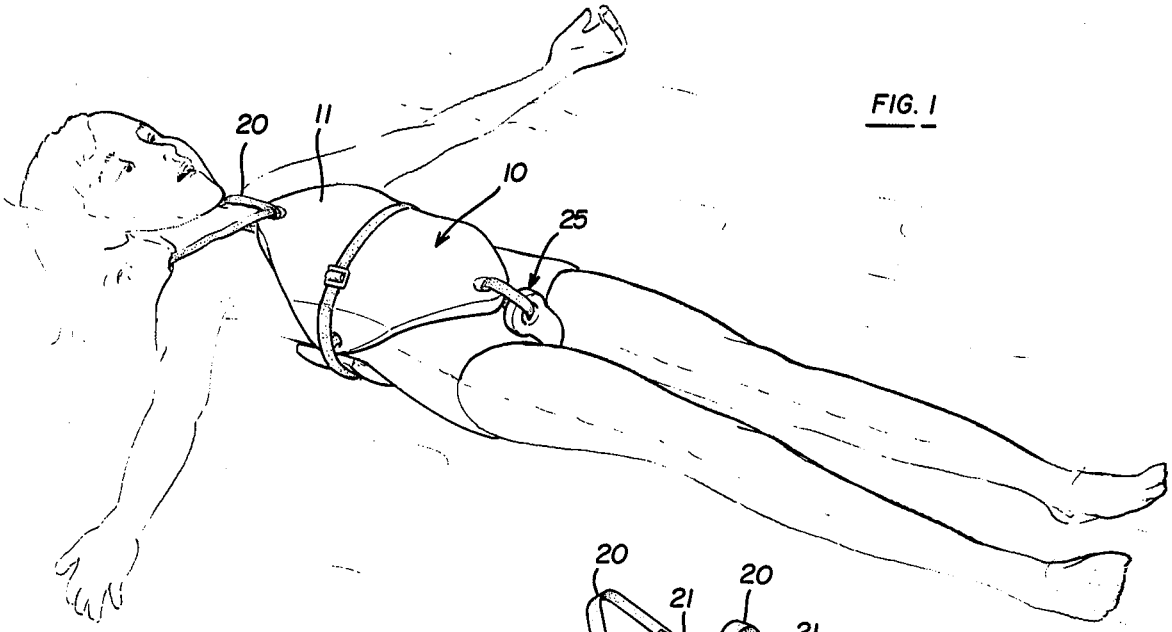
FIG. 1 illustrates a swimmer floating upon his back, wearing the swimmer's floatation aid herein.
Figure 2:
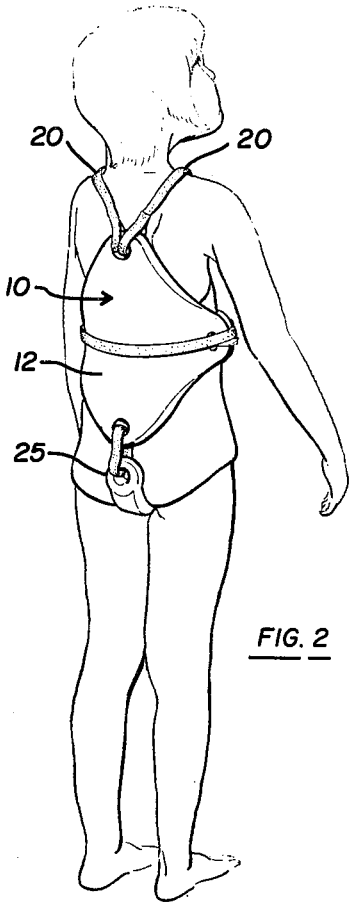
FIG. 2 is a rear view of the swimmer, in standing position, wearing the floatation aid.
Figure 3:
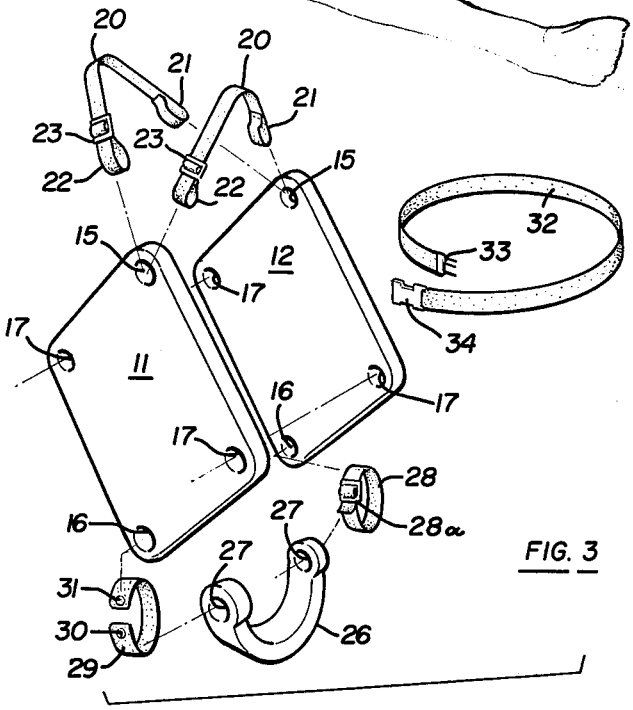
FIG. 3 is a disassembled view, in perspective, of the parts making up the floatation aid.

The sheets are preferably molded to provide a foam core 13 (see FIG. 3) and an exterior molded skin 14 surrounding the core to protect the foam against becoming water logged or damaged and also to provide a smooth surface. Conventional molding techniques may be utilized for the purpose of forming the sheet in the manner described.

Figure 5:
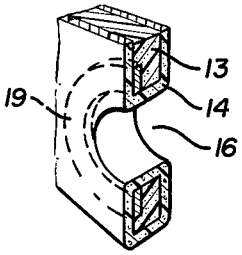
FIG. 5 is a further enlarged, fragmentary cross-sectional view showing the reinforcement of the openings in the sheets.

Each of the two sheets is provided with an upper hole 15, a lower hole 16 and side holes 17 at the appropriate corners thereof. As shown in FIG. 5, preferably the holes are lined or surrounded with a washer 19 or a suitable grommet for reinforcing the area surrounding the holes or openings.

The sheets are normally positioned against the front and rear surfaces of the swimmer's torso. Shoulder straps 20 suspend the sheets upon the body. These straps each may include a sewn loop 21 which pass through the hole 15 in one of the two sheets and a looped adjustable end 22, provided with a conventional slip type buckle 23 for adjusting the length of the shoulder strap. Thus, the straps may be adjusted for appropriate length depending upon the size of the swimmer. The type of buckles utilized for this purpose can vary within the availability of suitable commercial buckles for this purpose. Likewise, both ends of each strap can be provided with adjustable buckles rather than providing only one end with such adjustment means.

A crotch strap 25 interconnects the holes 16 in the lower corners of the sheets. The crotch strap is formed of an elongated strip 26 preferably made of the same material as the sheets, including a foam core and a molded skin. The opposite ends of the strip are provided with holes 27.

A looped strap connector 28 passes through one of the holes 27 and its adjacent sheet hole 16 for connecting the strip to that one sheet. The opposite end of the strip is provided with an openable strap connector loop 29 which may be provided with snap fastener halves 30 and 31 adjacent its opposite ends for closing the loop and thereby fastening the strip through the hole 16 in the opposite sheet.

The loop 28 may be provided with a suitable buckle **28*a* for permitting adjustment of the length of the loop. Thus, the position of the strap 25 can be adjusted by adjusting the length of its loop 28. The strap 25 may be fastened or released rapidly and conveniently by means of the snap fastener loop 29**.

A waistband or strap 32 is provided to encircle the wearer's torso at roughly the waist area or actually, a little above that area. Such strap may be provided with a quick release buckle 33 and an inter-engaging tongue 34 for interconnecting the opposite ends of the strap and releasing same quickly. Suitable buckles are available on the market for this purpose. Thus, the particular configuration of the buckle is not pertinent to the invention herein.

Figure 4:
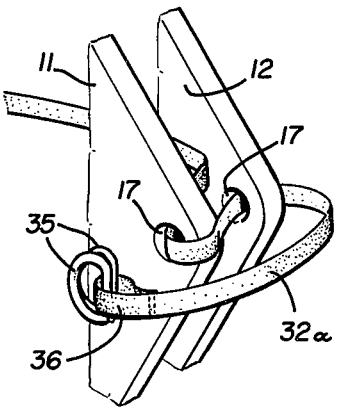
FIG. 4 is an enlarged, fragmentary view, of a pair of adjacent corners showing a modified form of waistband or strap.

FIG. 4 illustrates a modified form of waistband or strap **32*a*, which utilizes a pair of so-called D-rings 35 fastened in a sewn loop 36** to one end of the strap. The opposite end of the strap fits into the loops for fastening the two ends of the strap together, in the conventional manner.

Another form of strap (not shown) can utilize so-called "Velcro" attaching sections, instead of buckles or D-rings, for fastening the ends of the waist strap together and for releasing the ends quickly.

The strap material used for the shoulder, waist and lower loop, preferably is formed of a conventional woven strapping which is flexible, water-resistant and non-abrasive. Suitable material is readily available commercially.

As can be seen in the drawings, the front and rear sheets are applied to the torso in a manner to spread out the floatation affect over the maximum area possible, while at the same time freeing the muscle areas from interference. Consequently, the swimmers feel the affect of the floatation, thereby helping them develop confidence, while at the same time they can exert all of the normal swimming motions in an unrestricted manner.

In the case of utilization of this device for therapeutic swimming purposes or for the use of swimmers who are in some manner handicapped, the device provides the additional floatation needed to reduce the swimming effort and give the swimmer the confidence needed during swimming activities. At the same time, the device is not only very inexpensive, but also easy to apply and remove, which frequently is necessary in the case of usage with handicapped swimmers.

Having fully described an operative embodiment of this invention, we now claim:

1. A swimmer's floatation aid comprising:

a pair of substantially flat, thin, resilient, buoyant, approximately diamond shaped sheets, each having an upper corner, a lower corner and a pair of side corners;

said sheets being dimensioned to be applied against the front and the rear surfaces of a human torso with their upper corners located a short distance below the neck area, their lower corners located a short distance above the crotch area, and the side corners being roughly in the waist area with adjacent side corners of the two sheets being close to each other;

each sheet being formed with enlarged openings through the upper, lower, and side corners respectively;

strap means interconnecting the upper corners and extending over the shoulder portions of the torso, said strap means interconnecting the upper corners comprising a pair of narrow, flexible strap members, each arranged to extend over the swimmer's shoulder on opposite sides of the neck, and one end of the straps looped through a single enlarged opening in the upper corner of one sheet and the opposite end of said straps looped through a single enlarged opening in the upper corner of the other sheet;

strap means interconnecting the lower corners and extending around the crotch area between the legs of the swimmer, said strap means interconnecting the lower corners including an elongated strip of flexible, resilient, buoyant material formed of substantially the same material as the sheets, to thereby maintain the position of the sheets on the swimmer's body during swimming activity and to increase the floatation support in the crotch area of the torso;

and strap means interconnecting the adjacent side corners, said strap means interconnecting the side corners comprising a long, narrow strap of a length to extend around the swimmer's body approximately in the waist area thereof, and to pass through adjacent corner openings, and including releasable fastening means for connecting the opposite ends of the strap together and for releasing the strap from around the swimmer's body;

wherein said sheets generally conform to the shape of the torso, without substantially bulging therefrom, and wherein the swimmer's arms, shoulder and shoulder muscle portions, and the hip and upper leg portions are uncovered and unrestricted so that the aid provides a limited floatation assistance, but avoids interference with swimming activity movements of the swimmer's body.

2. A swimmer's floatation aid as defined in claim 1, and including a rigid, reinforcing ring surrounding each enlarged opening and secured to the sheet for reinforcing the respective sheet corner portions at the connections to said strap means.

3. A swimmer's floatation aid as defined in claim 1, and each of the opposite end portions of said elongated strip of flexible, resilient, buoyant material being formed with an opening therethrough, and each end of the strip having a short length of flexible strap material extending through its respective opening and the opening formed in the adjacent sheet corner for flexibly interconnecting the strip to the sheets.

* * * * *